US006568509B1

(12) United States Patent
Sugiura

(10) Patent No.: US 6,568,509 B1
(45) Date of Patent: May 27, 2003

(54) OIL PAN STRUCTURE FOR INTERNAL COMBUSTION ENGINE

(75) Inventor: Hisahito Sugiura, Shizouka-Ken (JP)

(73) Assignee: Suzuki Motor Corporation, Shizuoka-ken (JP)

( * ) Notice: Subject to any disclaimer, the term of this patent is extended or adjusted under 35 U.S.C. 154(b) by 0 days.

(21) Appl. No.: 09/467,674

(22) Filed: Dec. 21, 1999

(30) Foreign Application Priority Data

Dec. 22, 1998 (JP) ..... 10-364321

(51) Int. Cl.[7] ..... F16N 31/00
(52) U.S. Cl. ..... 184/106
(58) Field of Search ..... 184/6.2, 106; 123/196 R, 123/196 S

(56) References Cited

U.S. PATENT DOCUMENTS

| | | | | | |
|---|---|---|---|---|---|
| 1,396,050 | A | * | 11/1921 | Palmer | 184/106 |
| 1,874,585 | A | * | 8/1932 | Newcomb | 184/106 |
| 2,440,815 | A | * | 5/1948 | Wharam et al. | 184/106 |
| 2,480,486 | A | * | 8/1949 | Leazer | 184/106 |
| 2,938,601 | A | * | 5/1960 | Brafford | 184/6.2 |
| 3,189,126 | A | * | 6/1965 | May | 184/106 |
| 4,346,786 | A | * | 8/1982 | Midgley | 184/6.2 |
| 4,519,348 | A | * | 5/1985 | Hamilton | 184/106 |
| 4,616,609 | A | * | 10/1986 | Munch et al. | 184/106 |
| 4,909,203 | A | * | 3/1990 | Fukuo | 184/106 |
| 4,938,184 | A | * | 7/1990 | Martin et al. | 184/106 |
| 5,103,782 | A | * | 4/1992 | Matsui | 184/106 |
| 5,301,642 | A | * | 4/1994 | Matsushiro et al. | 184/106 |
| 5,664,537 | A | * | 9/1997 | Beranek et al. | 184/106 |

FOREIGN PATENT DOCUMENTS

| | | |
|---|---|---|
| JP | 59-107911 U | 7/1984 |
| JP | 05-86826 | 4/1993 |
| JP | 06-39047 Y | 10/1994 |
| JP | 2517700 Y | 11/1996 |
| JP | 2518683 Y | 11/1996 |
| JP | 09-068024 | 3/1997 |
| JP | 09-072209 | 3/1997 |

* cited by examiner

*Primary Examiner*—Chong H. Kim
(74) *Attorney, Agent, or Firm*—Darby & Darby

(57) ABSTRACT

An oil pan (2) fixed on an engine mounted on a vehicle with an inclination angle has a first baffle plate (4), a portion of which is horizontally disposed, in the inside of the oil pan, a second baffle plate (5) disposed vertically between the first baffle plate (4) and the bottom of the oil pan (2) such that said second baffle plate (5) partitions the space into two compartments, and an oil passageway between the two compartments. Since the oil passage way reduces mixed air bubbles in the oil when the oil flows through the passageway, either compartment has less mixed air bubbles such that the oil surface levels in the two compartments may be equalized and that the aeration may be reduced.

9 Claims, 4 Drawing Sheets

OIL PAN STRUCTURE FOR INTERNAL COMBUSTION ENGINE

FIELD OF THE INVENTION

The present invention relates to an oil pan structure of an engine mounted with an axial line of a cylinder of the engine inclined to the vertical direction, and more particularly to the oil pan structure of the engine mounted with a great inclination angle.

BACKGROUND OF THE INVENTION

Since a commercial vehicle such as a truck cannot have so large engine compartment as a passenger car does, the commercial vehicle may hold its engine under the floor. In such arrangement, the engine is mounted on the vehicle with an axial line of a cylinder of the engine inclined to the vertical direction (so-called a slant engine). Since the engine is mounted in such a manner, its oil pan, which is located at the lowest position, has a different shape from the usual tray-like structure. Tokukai No. Hei 5-86826, for example, discloses an oil pan, of which cross-section is almost a triangle. The specification discloses the invention of the oil pan structure, which includes two chambers (or compartments) with different oil levels within the oil pan, to store enough amount of oil without making the oil pan much bigger. The invention can prevent an oil pump from sucking air when the oil pump sucks oil since an oil strainer, which is an inlet of the oil pump, is disposed in the chamber with higher oil level.

Other than the above publication, Jitsukou No. Hei 6-39047 discloses an invention to change an oil strainer position for an inclined or slant engine. The invention prevents an oil pump from sucking air with oil when the pump sucks the oil by shifting the oil strainer position. However, the invention does not remove mixed air from the oil.

Registered Utility Model No. 2518683 discloses an oil pan having at lease two partition plates within the oil pan for a slant engine. The invention prevents an oil pump from sucking air with oil when the pump sucks the oil by disposing an oil strainer between the two partition plates which are disposed within the oil pan. However, it does not remove already-mixed air from the oil.

Jitsukai No. Sho 59-107911 discloses a baffle plate, to which weight is secured, disposed in an oil pan body.

Both Tokukai No. Hei 9-72209 and Tokukai No. Hei 9-68024 disclose an auxiliary baffle plate in addition to a main baffle plate. These inventions decrease bubble generation when oil drops on the surface of stored oil and allow an oil pump to suck the stored oil, from which mixed air is removed or decreased.

Although the prior art shows these inventions which achieve individual goals or solve problems, respectively, it does not teach any inventions to decrease amount of the air mixed with the oil during lubrication of a crankshaft or other elements when the oil is stored and ready for being sucked by the oil pump, or prevent the oil pump from sucking air mixed with oil, which is stored in the oil pan, through the oil strainer.

OBJECT OF THE INVENTION

Oil dropped from a cylinder block of an engine is returned back to an oil pan after passing around a crankshaft. Since the crankshaft is not moving while an engine is not operating, oil comes down along the cylinder block wall to a first baffle plate, comes into an oil dropping hole on the first baffle plate, which directs the oil towards a bottom of an oil pan, and is returned to the inside of the oil pan. While the engine is operating, much oil seems to be splashed to the crankshaft and circulated around the crankshaft. The oil finally directed to the bottom of the oil pan contains a lot of air bubbles so that it may cause deterioration of aeration performance (oil property endurance to the aeration). Thus, the object of the present invention is to reduce the aeration (mixed air percentage in the oil).

Therefore, the present invention provides the oil pan structure of the engine to keep two oil levels within a certain difference of two chambers partitioned by a second baffle plate in the oil pan in order to reduce the oil level change by vehicle turn and to reduce the aeration at the same time.

SUMMARY OF THE INVENTION

The present invention seeks to achieve the above-mentioned goal and provides the oil pan having a horizontal bottom plate and secured to the engine mounted on the vehicle body such that its cylinder axial line is inclined to the vertical face including the crankshaft axis, comprising: a first baffle plate having a horizontal portion separated with a certain distance from the bottom of the oil pan, the first baffle plate having a first opening directing oil towards the bottom of the oil pan; a second baffle plate disposed vertically between the first baffle plate and the bottom of the oil pan to partition the space into two compartments; and an oil passing passageway disposed in a lower position than the horizontal portion of the first baffle plate so that the oil may pass through the passageway between the two compartments in order to equalize the oil level of each compartment (or chamber).

In accordance with the present invention, the first baffle plate can prevent oil from dropping directly from the cylinder block to the surface of the oil stored in the oil pan so as to reduce generation of air bubbles and it can be possible to accelerate removing mixed air bubbles from the oil in either compartment of the two compartments so as to reduce the aeration.

Since the oil passageway (second opening) equalize oil surface heights in the compartments is formed in a portion near the bottom of the oil pan in the second baffle plate the oil passageway may allow oil having relatively less mixed air bubbles to flow between two compartments so that the aeration is effectively reduced when the oil with less air bubbles flows into the other compartment where an oil pump sucks oil up.

In accordance with the present invention, the oil pan structure further comprises an oil strainer for sucking oil in one of the two compartments and an oil dropping hole (third opening) such that the oil may efficiently be collected and the mixed air bubble may efficiently be removed.

DETAILED DESCRIPTION OF PREFERRED EMBODIMENT

Figure 1:
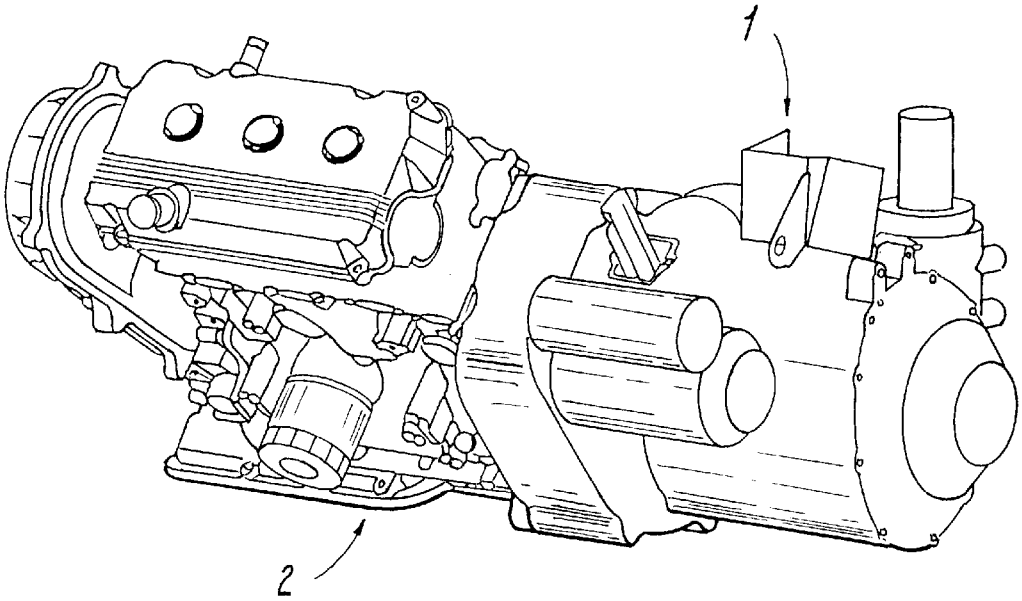
FIG. 1 is a perspective view of an engine to which the present invention is applied.

The invention is hereinafter described in details referring to the drawings.

FIG. 1 shows an engine 1 mounted with such inclination angle as shown. The engine has an oil pan 2 shaped differently from a regular tray-type oil pan.

First Embodiment

Figure 2:
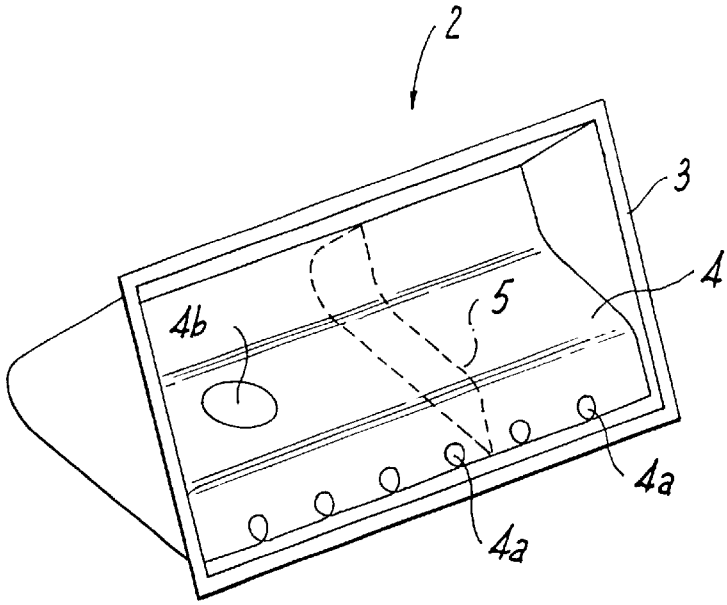
FIG. 2 is a perspective view of an oil pan of a preferred embodiment of the present invention shown in FIG. 1.

FIG. 2 shows an oil pan 2 of an embodiment of the present invention. The oil pan 2 has a different shape from a regular tray-type oil pan. A housing 3 of the oil pan 2 is formed to have a side view of a triangle as shown in the figure. The housing 3 is a hollow triangular prism with one side face open. Since the oil pan 2 is secured to the engine 1 in such direction as shown in FIG. 2, the bottom face (one of the side faces of the hollow triangular prism, but not the open side face) in FIG. 2, which shows the oil pan 2 with the open side face of the hollow triangular prism facing towards the front, corresponds to the real bottom face, which is horizontal, when the oil pan 2 is fixed on the engine 1. Inside of the housing 3, a first baffle plate 4 is disposed horizontally with a certain distance from the bottom face of the oil pan 2 such that oil having air bubbles after lubricating elements may not drop from a cylinder block or a crank case directly to the surface of oil stored in the oil pan 2. A horizontal portion of the first baffle plate 4 extends to the full width inside the oil pan 2 as viewed from the open side face as positioned in FIG. 2. A vertical projection of the horizontal portion on the bottom face of the oil pan 2 is located around the middle of the bottom face in the length direction. The first baffle plate 4 has a slope portion, which is higher if it goes deeper, in deep inside of the oil pan 2 and a slope portion, which is lower if it comes more front, near the open side face. The first baffle plate 4 has a plurality of oil dropping holes 4*a* (first openings) lined in the width direction that directs oil, which drops from the crank case side and comes along the horizontal portion and the front slope of the first baffle plate 4, finally goes down to the bottom of the oil pan 2. In the first embodiment, although the first openings 4*a* are circular and similar in sizes, these openings 4*a* may be different in shapes and in sizes. And the first baffle plate 4 has an oil strainer hole 4*b* (opening) in the middle along the length direction, if viewed from top, and in the left hand side along the width direction, if viewed from the open side face, of the horizontal portion of the first baffle plate 4.

Under the first baffle plate 4, a second baffle plate 5 is disposed to partition the space between the first baffle plate 4 and the bottom face of the housing 3 of the oil pan into two compartments (or chambers). The second baffle plate 5 is positioned to prevent oil from moving to one side in the crankshaft axial direction in the oil pan 2 when the vehicle makes abrupt acceleration or deceleration, climbs up or down on a steep slope, or turns.

In such an oil pan structure, the relative ratio of received oil amounts from the crank case side into two compartments may be adjusted by changing sizes and positions of the oil dropping holes 4*a* (first openings). In the first embodiment of the present invention, a recessed portion between the front slop portion, where the oil dropping holes 4*a* (first openings) are made, of the first baffle plate and a lower portion of the crank case may serve as a passageway (see FIG. 4).

In the first embodiment, the first baffle plate is disposed to cover the whole bottom face of the oil pan 2 except the first openings 4*a*. However, it is not necessary to cover the whole bottom face, but to cover the bottom face such that oil from the cylinder block may not drop directly on the surface of the stored oil in the oil pan 2. It goes without saying that the oil from the cylinder block may partially drop directly on the surface of the stored oil in the oil pan 2 as long as the amount is small.

Second Embodiment

Figure 3:
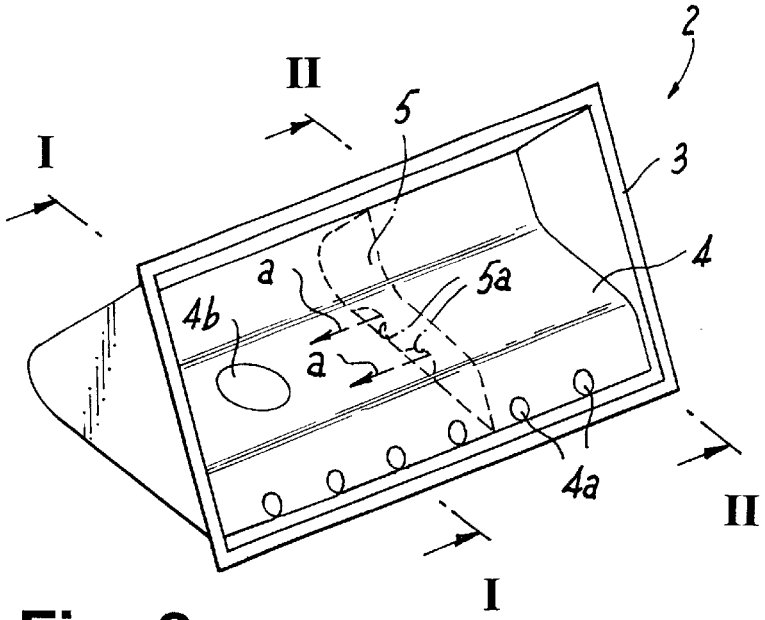
FIG. 3 is a perspective view of an oil pan of another embodiment of the present invention.

FIG. 3 shows another embodiment of the present invention. FIG. 3 is corresponding to FIG. 2 of the first embodiment and thus has only difference from FIG. 2 that the second baffle plate 5 has openings 5*a* (second openings) near the bottom of the oil pan2. Since the second baffle plate 5 has openings 5*a* (second openings), oil may pass through the openings, as indicated by an arrow 'a,' between two compartments partitioned by the second baffle plate 5 such that the oil surface height of each compartment may not be very different. Since the openings 5*a* (second openings) are made near the bottom face of the oil pan 2, mixed air bubbles, which tend to float upper with buoyancy, are hard to pass the openings 5*a* (second openings). Therefore, the compartment, into which the oil flows through the openings 5*a* (second openings), stores oil having relatively less air bubbles.

Figure 4:
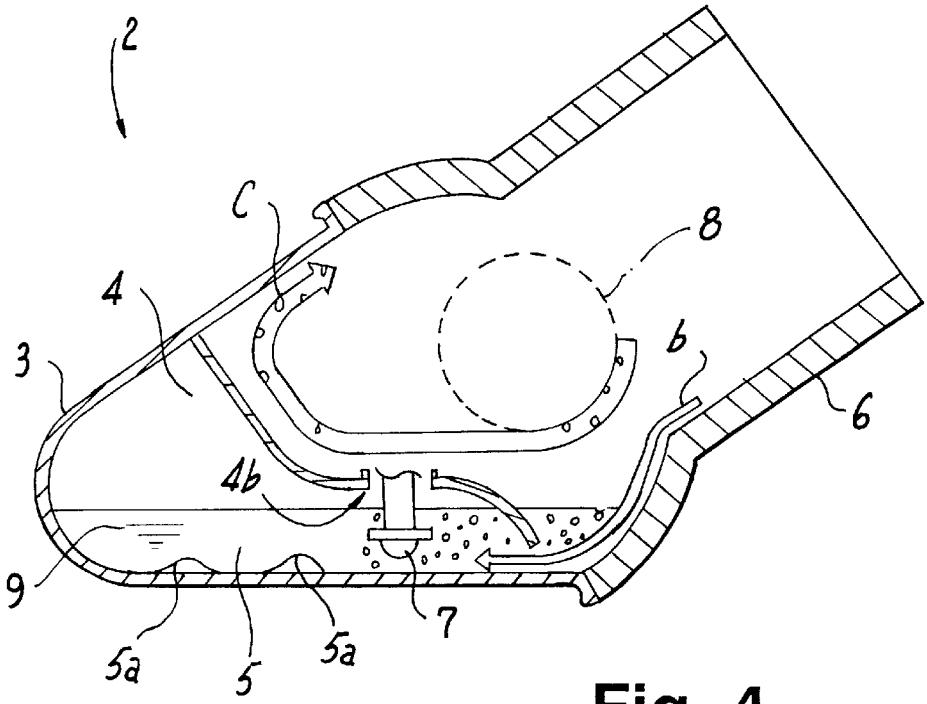
FIG. 4, is an I—I sectional view of the oil pan shown in FIG. 3. The figure illustrates a function when the oil pan is operatively secured to the crank case.
Figure 5:
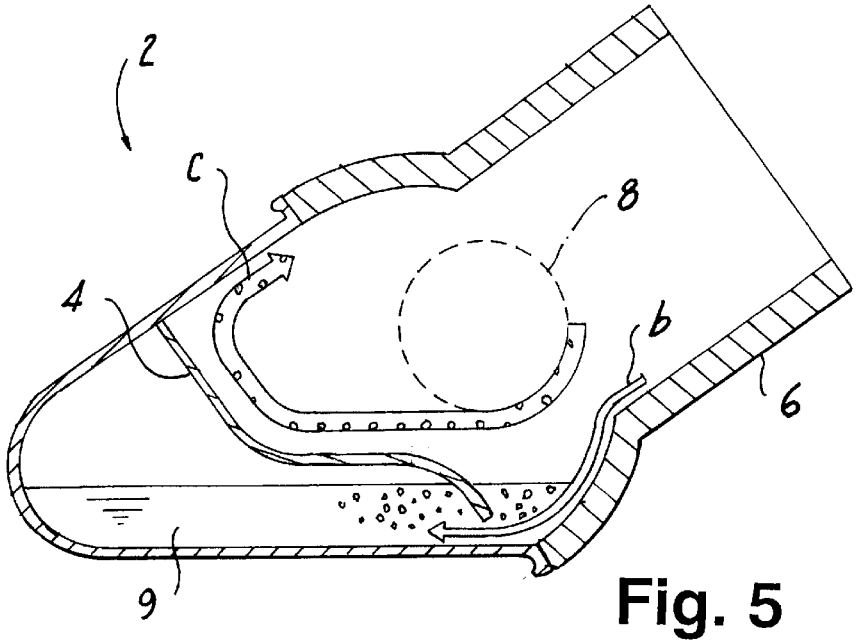
FIG. 5, is a II—II sectional view of the oil pan shown in FIG. 3. The figure illustrates a different portion from that shown in FIG. 4.

FIG. 4 is an I—I sectional view of FIG. 3 from the left hand side. The figure illustrates how the oil pan 2 is fixed on the crank case 6 of the engine. The first baffle plate 4, as shown in the figure, has a slope portion descending from left to right, an approximately horizontal portion, where a hole 4*b* for an oil strainer 7 passing through, and a slope portion descending again from left to right, where the oil dropping holes 4*a* (first openings) are made, then the first baffle plate 4 finally further descends to the bottom face of the housing 3. The crankshaft 8 is disposed inside the crank case 6. FIG. 5 is a II—II sectional view of FIG. 3 from the left hand side. In FIG. 5, no opening for the oil strainer exists and the cross section of the horizontal portion of the first baffle plate is shown without any break.

As shown in FIGS. 4 and 5, there is oil 9 in the housing 3 of the oil pan 2. The oil 9 is sucked from the oil strainer 7 with an oil pump (not shown) and transferred to parts that should be lubricated. Most oil after circulation and lubrication runs down to the bottom of the housing 3 along the wall of the crank shaft case 6. But some oil circulates clockwise as indicated by an arrow 'c' while the crankshaft 8 rotates in the same direction, and drops finally.

FIGS. 4 and 5 show two compartments divided by the second baffle plate 5, respectively. Each compartment usually has a different amount of dropping oil from the crank case 6 side. As shown in FIGS. 3 and 4, in accordance with the present invention, since the second baffle plate 5 has holes 5*a* (second openings), the oil flows as indicated by an arrow 'a' (the oil may flow in the opposite direction of the arrow) and the oil surface heights are generally equalized.

Thus, in the second embodiment of the present invention, since the second baffle plate partitions the inside of the oil pan 2 into the two compartments, it is possible to restrict oil movement on one side in the crankshaft axial direction when the vehicle makes a turn or the like. Further, the openings 5*a*

(second openings) made in some portions of the second baffle plate 5 allow oil to pass between the two compartments resulting in similar oil surface heights in the two compartments. In the second embodiment, the oil passageway between the two compartments as mentioned in the first embodiment is not necessarily to be closed although the oil passageway may be closed by a third baffle plate or the like.

Third Embodiment

Figure 6:
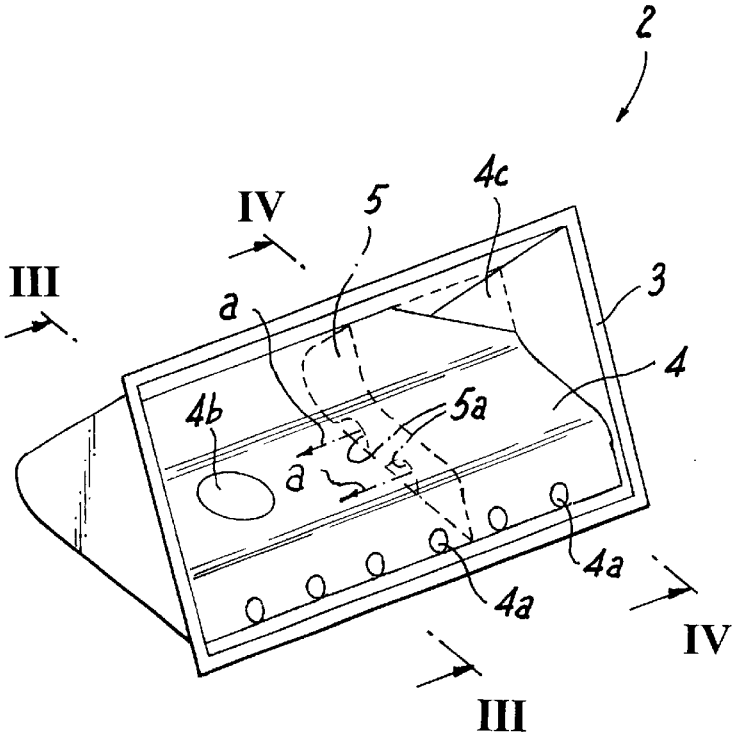
FIG. 6 is a perspective view of the oil pan of another embodiment of the present invention.
Figure 7:
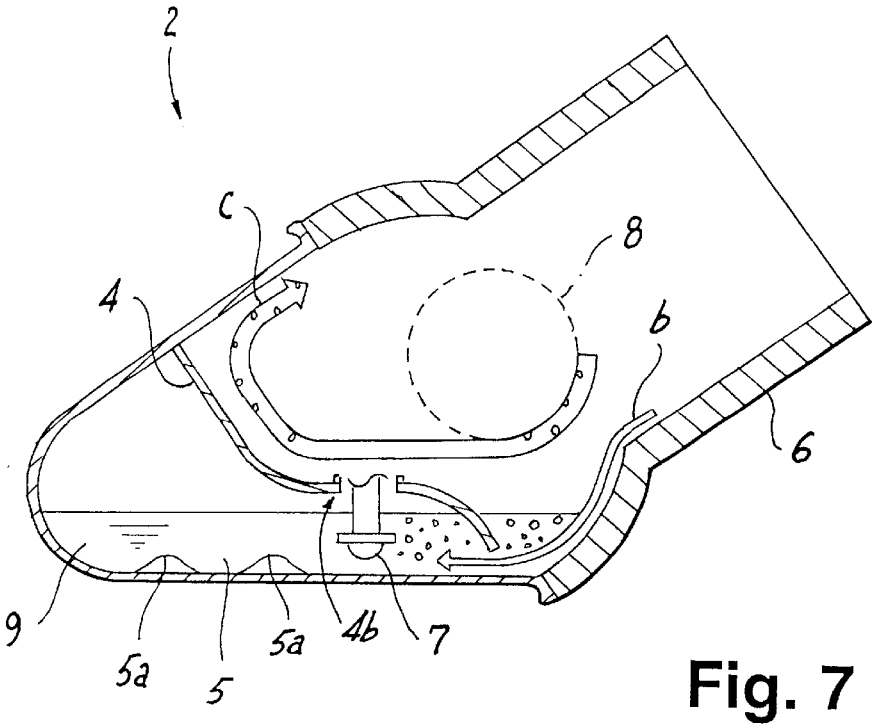
FIG. 7 is an III—III sectional view of the oil pan shown in FIG. 6. The figure illustrates a function when the oil pan is operatively secured to the crank case.
Figure 8:
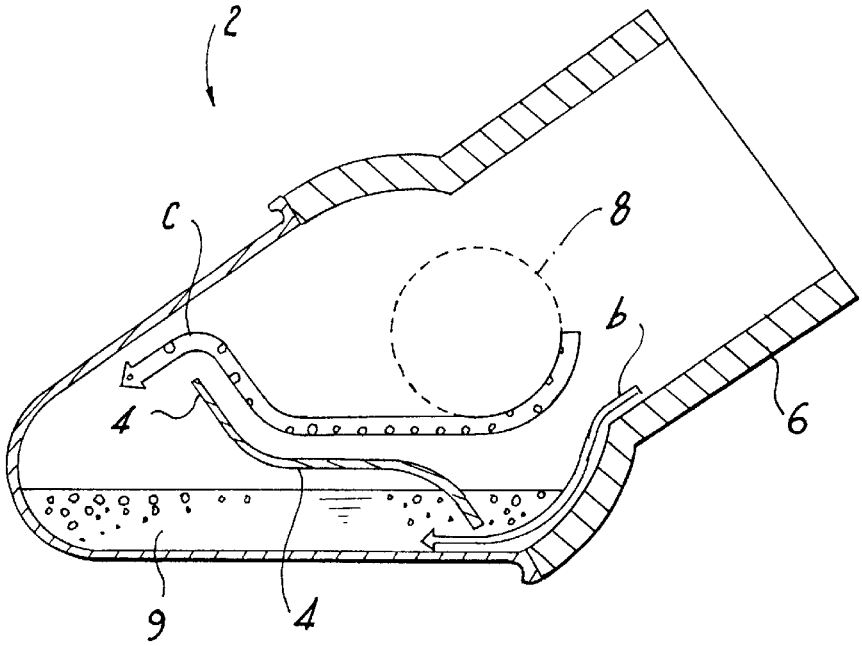
FIG. 8. is a IV—IV sectional view of the oil pan shown in FIG. 6. The figure illustrates a different portion from that shown in FIG. 7.

FIG. 6 shows another embodiment of the present invention, FIG. 7 shows an III—III sectional view of FIG. 6 from the left hand side. FIG. 8 is a IV—IV sectional view of FIG. 6 from the left hand side. These figures are corresponding to FIGS. 3, 4, and 5 of the previous embodiment and are only different in an opening as mentioned below. In the third embodiment, the first baffle plate 4 has an oil dropping hole 4*c* (third opening) from the cylinder block side over one compartment, where the oil strainer 7 is not disposed, of the two compartments partitioned by the second baffle plate 5. Thus, with the hole 4*c* (third opening), as shown in FIG. 8, most oil circulating clockwise around the crankshaft 8 in accordance with the crankshaft 8 rotation drops through the hole 4*c* (third opening) to the bottom of the oil pan 2. Then, oil with relatively large amount of mixed air bubbles is stored in the compartment in which the oil strainer 7 is not disposed, flows to the other compartment through the openings 5*a* near the bottom of the oil pan 2 made in the second baffle plate 5, and is sucked from the oil strainer 7 with the oil pump. Therefore, the traveling distance of the oil is so long as to have more opportunities to degas the oil and the oil passes through the opening 5*a* (second openings) near the bottom of the oil pan 2 so that mixed air bubbles may be eliminated. The third embodiment can improve the aeration performance since less air bubbles in the oil is sucked with the pump.

What is claimed is:

1. An oil pan structure on an engine which is mounted in a vehicle body with a cylinder axial line of a cylinder block of said engine inclined to a vertical face, said engine including a crankshaft having a rotation axis, the oil pan structure having a horizontal bottom face section affixable on said engine, said oil pan structure comprising:

a top face section affixable to said engine parallel to said rotation axis;

said horizontal bottom face section parallel to said rotation axis;

said top face section inclined to said horizontal bottom face at an angle acute to said horizontal bottom face;

said top face section continuous with said horizontal bottom face along a connecting radius;

said top face section in a plane parallel to a tangent extended from said external crank shaft;

a first and a second side face sections perpendicular to said crankshaft;

said first and said second side face sections joining said top face section to said horizontal bottom face section bounding an oil retention area opposite said external crank shaft;

said oil retention area effective to receive oil from said external engine and said external crank shaft, retain said oil on a plurality of transport surfaces, and transport said oil along said transport surfaces to form an oil pool having a surface substantially parallel to said horizontal bottom face;

a first baffle plate disposed in said oil pan structure between said first and said second side face, and continuously joining said top face section to said horizontal bottom face section;

said first baffle plate effective to receive said oil flung from said external crankshaft and said engine, and transport said oil to said oil pool without agitating said oil pool and entraining air in said oil;

said first baffle plate having a horizontal portion, a first and a second sloped portion;

said horizontal portion parallel said horizontal bottom face section opposite said oil surface;

said first sloped portion extends from said top face section to said horizontal portion and directs said oil to at least said horizontal portion thereby reducing entrained air in said oil and preventing additional entrainment;

said second sloped portion extends from said horizontal portion to said horizontal bottom face;

said first and second sloped portions substantially parallel a first joining surface of said external engine;

said first baffle plate having at least a first opening on said second sloped portion adjacent said horizontal bottom face;

said at least first opening effective to receive oil from said first sloped portion, said horizontal section, said second sloped portion, and said external engine and direct said oil to a bottom portion of said oil pan structure below said horizontal portion without agitating and dripping said oil thereby minimizing air entrainment in said oil;

said first baffle plate including at least a third opening;

said third opening on at least said first sloped portion adjacent said top face section;

said third opening effective to receive said oil thrown from said external crankshaft and direct said oil to said bottom portion of said oil pan structure;

a second baffle plate disposed vertically between said first baffle plate said horizontal bottom surface;

said second baffle plate effective to divide said bottom portion into a first and a second compartment;

said second baffle plate having at least a second opening; and said second opening effective to transport said oil from said first compartment to said second compartment and maintain substantially equivalent oil surface heights in said first and said second compartment without agitating said oil and maximizing an oil residence time in said first compartment before transporting said oil to said second compartment, whereby said entrained air in said oil is minimized in said second compartment.

2. The oil pain structure of claim 1, wherein:

said first baffle plate further comprises a plurality of first openings adjacent said second sloped portion adjacent said horizontal bottom face.

3. The oil pan structure of claim 1, wherein:

said third opening is positioned on said at least second sloped portion and said horizontal portion and effective to receive said oil flung from said crankshaft rotation and direct said oil to said bottom portion of said oil pan structure whereby air entrainment is minimized in said oil.

4. The oil pan structure of claim 3, wherein:

said third opening is adjacent to a housing of said oil pan structure.

5. The oil pan structure of claim 1, wherein:

said at least second opening is a plurality of openings effective to transport said oil without agitating said oil.

6. The oil pan structure of claim 1, further comprising:

an oil strainer hole in said horizontal portion formed to receive an external oil strainer for transporting said oil disposed near a bottom of said oil pan structure in one of said first and said second compartment partitioned by said second baffle plate.

7. The oil pan structure of claim 6, further comprising:

said third opening being over said other of said first and said second compartment in which said oil strainer is not disposed.

8. The oil pan structure of claim 7, wherein:

said third opening is positioned on said at least second sloped portion and said horizontal portion and effective to receive said oil from said crankshaft rotation and direct said oil to said bottom portion of said oil pan structure whereby air entrainment is minimized in said oil.

9. The oil pan structure of claim 7, wherein:

said third opening is adjacent to a housing of said oil pan structure.

* * * * *